US005412894A

United States Patent [19]

Moon

[11] Patent Number: 5,412,894

[45] Date of Patent: May 9, 1995

[54] INERTIA DRIVEN STRIKER FOR A FIREARM

[76] Inventor: Kook-Jin Moon, 630 Rte. 303, Blauvelt, N.Y. 10913

[21] Appl. No.: 130,873

[22] Filed: Oct. 4, 1993

[51] Int. Cl.[6] ..... F41A 19/13

[52] U.S. Cl. ..... 42/69.02; 89/197

[58] Field of Search ..... 42/69.02, 69.01, 69.03; 89/197

[56] References Cited

U.S. PATENT DOCUMENTS

| | | | |
|---|---|---|---|
| 1,020,596 | 3/1912 | Brauning | 42/69.02 |
| 1,165,621 | 12/1915 | Nelson | 42/69.02 |
| 1,226,478 | 5/1917 | Diehm | 89/198 |
| 3,217,441 | 11/1965 | Kerr | 42/69.01 |
| 3,237,335 | 3/1966 | Kerr | 42/8 |
| 3,857,324 | 12/1974 | Tant | 89/197 |
| 5,235,770 | 8/1993 | Simon et al. | 89/69.01 |

*Primary Examiner*—David Brown
*Attorney, Agent, or Firm*—McCormick, Paulding & Huber

[57] ABSTRACT

An inertia striker assembly including a striker and a U-shaped spacer straddling the striker, both the striker and the spacer being free to slide axially and independently within a cylindrical bore in a slide body. The U-shaped spacer transfers energy from a striker spring to the striker to propel the striker from a cocked position toward a firing position. Movement of the U-shaped spacer is arrested by engagement of the spacer with an abutment surface within the bore allowing the striker to complete its travel to the firing position under its own inertia.

11 Claims, 4 Drawing Sheets

INERTIA DRIVEN STRIKER FOR A FIREARM

FIELD OF THE INVENTION

This invention relates to firearms and more particularly to an improved inertia drive striker for firearms.

BACKGROUND OF THE INVENTION

The striker assembly of the present invention is particularly adapted for use in a compact semi-automatic handgun. A striker assembly of the type used in such a small handgun usually comprises an intricate mechanism having several small interacting parts which require considerable manual dexterity to handle and assemble. Consequently, the occasional stripping, cleaning and reassembling operation essential to proper gun maintenance and which requires handling these small parts can prove to be a troublesome chore for the average gun owner.

SUMMARY OF THE INVENTION

In accordance with the present invention an improved inertia striker mechanism for a firearm includes a slide body having a forwardly facing breech face and a bore extending through a portion of the slide body and opening through the breech face. A striker assembly supported for reciprocal sliding movement within the bore between cocked and firing positions includes a striker having a tip at its forward end which projects through and forwardly beyond the breech face when the striker is in firing position. Biasing means acts between the slide body and a generally U-shaped spacer straddling the striker to propel the spacer and the striker toward firing position. An abutment surface on the slide body halts movement of the spacer in the direction of the firing position before the striker reaches its firing position so that the striker is free to move relative to the slide body and the spacer in response to inertia during the final portion of its travel to firing position.

BRIEF DESCRIPTION OF THE DRAWINGS

Other objects, features and advantages of the present invention will become apparent by the following details of the preferred but nonetheless illustrative, embodiment taken in conjunction with the following drawings, wherein.

DETAILED DESCRIPTION OF THE PREFERRED EMBODIMENT

Figure 1:
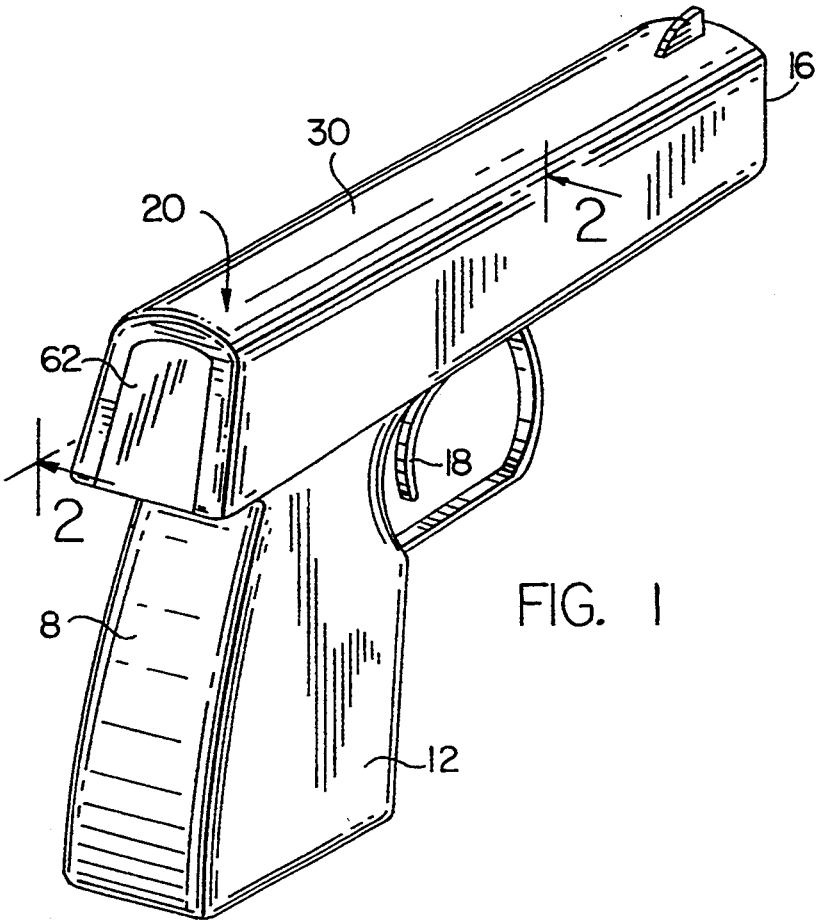
FIG. 1 is a perspective view of a semi-automatic firearm embodying the present invention.

Referring to the drawings, the striker assembly embodying the present invention is shown in a semi-automatic weapon, by way of example, in the drawing of FIG. 1. The weapon includes a frame 8, a handle 12, a slide body 30, a barrel (not shown), a front or muzzle end 16, a trigger 18, and a breech end, generally designated 20.

Figure 2:
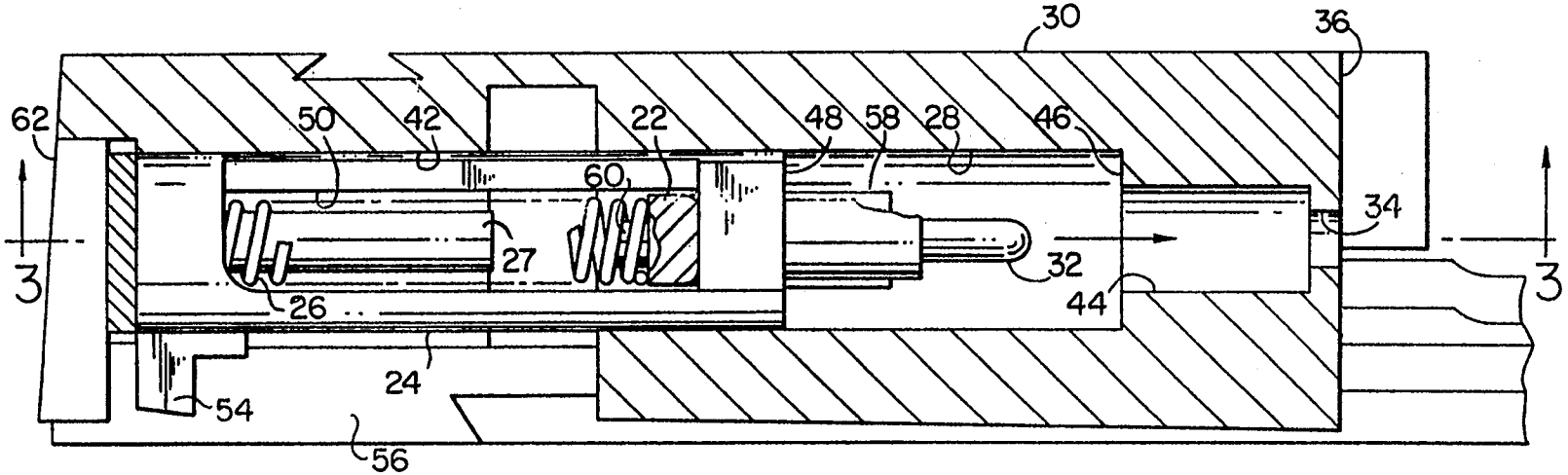
FIG. 2 is a somewhat enlarged fragmentary sectional view taken generally along the line 2—2 of FIG. 1 and showing particularly the striker, spring, spacer and slide body.

FIG. 2 shows the striker assembly in more detail as including a striker spacer 22, a striker 24 abutting the spacer, a striker spring 26 and a spring guide rod 27.

The striker assembly is received within the stepped cylindrical bore 28 which extends through a portion of the slide body 30. The bore 28 has a generally cylindrical rear portion 42, a diametrically reduced intermediate portion 44 which communicates with the rear portion 42 and a further reduced forward end portion 34 which communicates with the intermediate portion 44 and opens through a forwardly facing breech face 36 defined by the slide body. A rearwardly facing annular abutment surface 46 is located at the juncture of the rear portion 42 and the intermediate portion 44.

Figure 3:
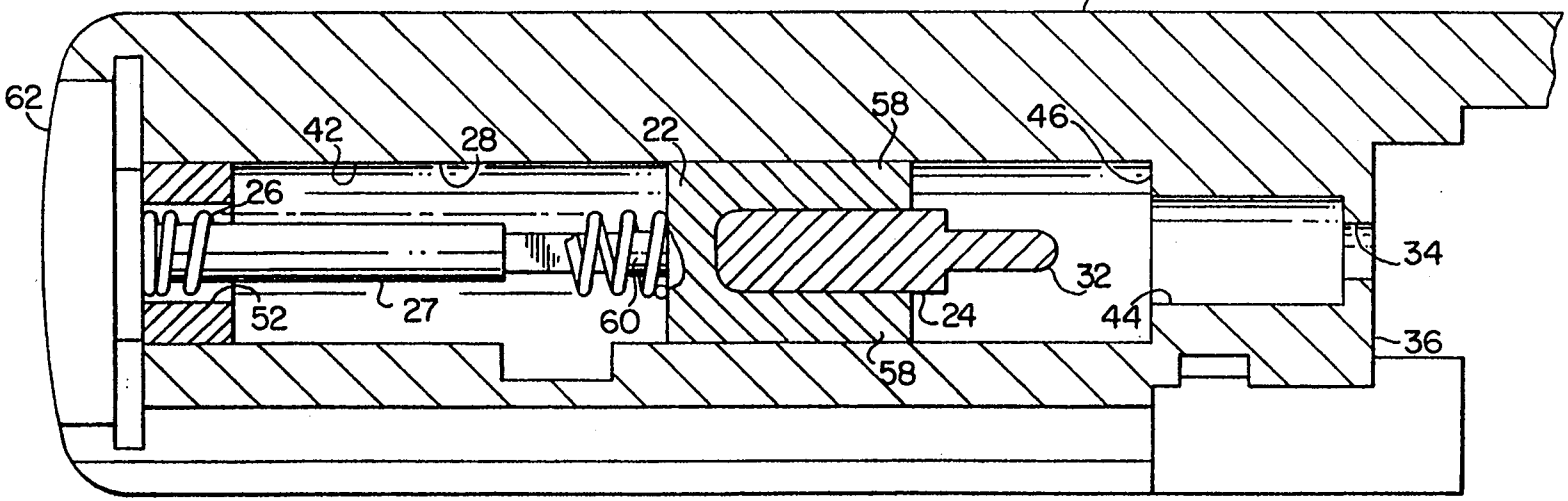
FIG. 3 is a fragmentary sectional view, taken along the line 3—3 of FIG. 2.
Figure 4:
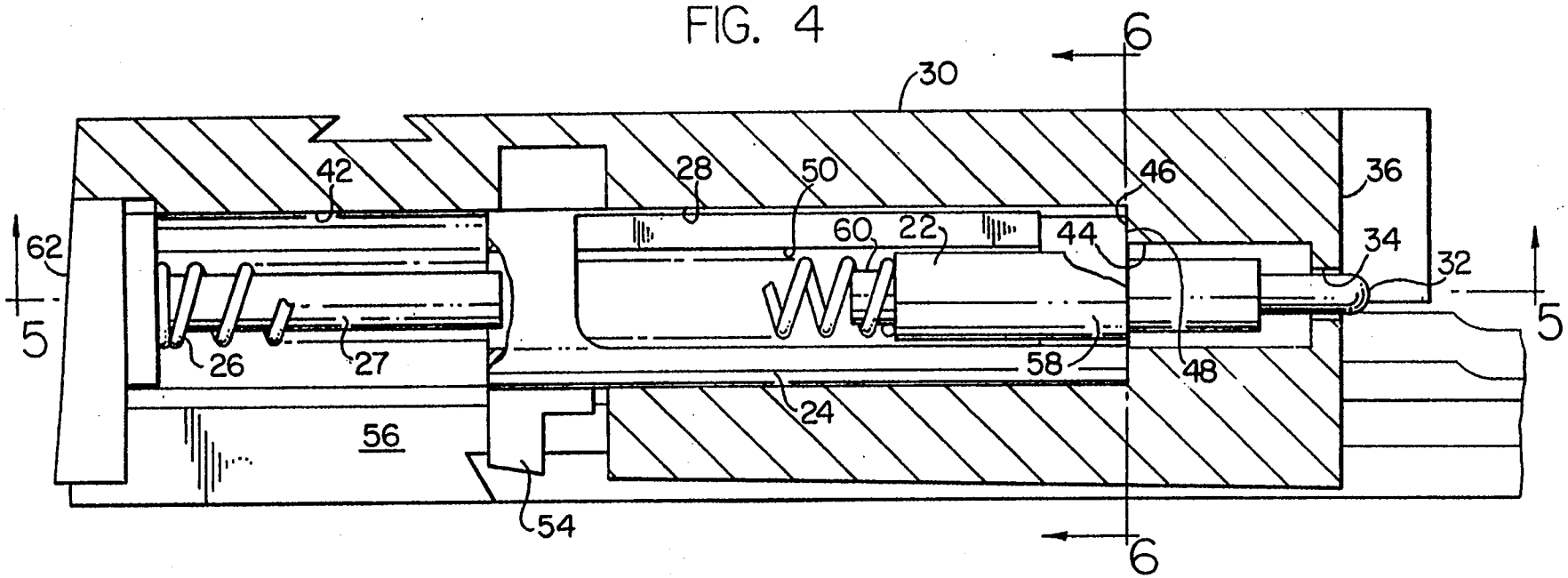
FIG. 4 is a view similar to that of FIGS. 2 and 3, but showing particularly the protrusion of the striker tip through the breech face when the striker is in its striking position.
Figure 7:
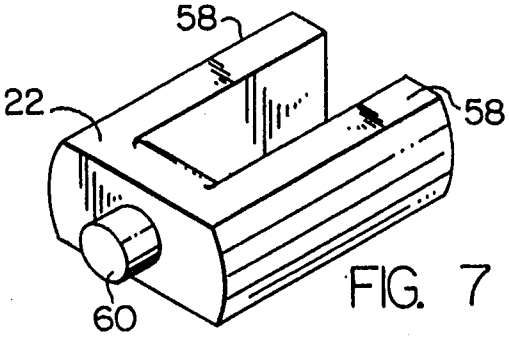
FIG. 7 is a perspective view of the U-shaped spacer.
Figure 6:
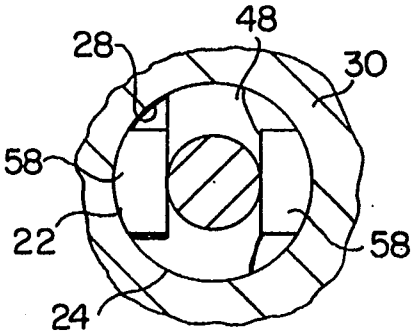
FIG. 6 is a fragmentary sectional view taken along the line 6—6 of FIG. 4.
Figure 5:
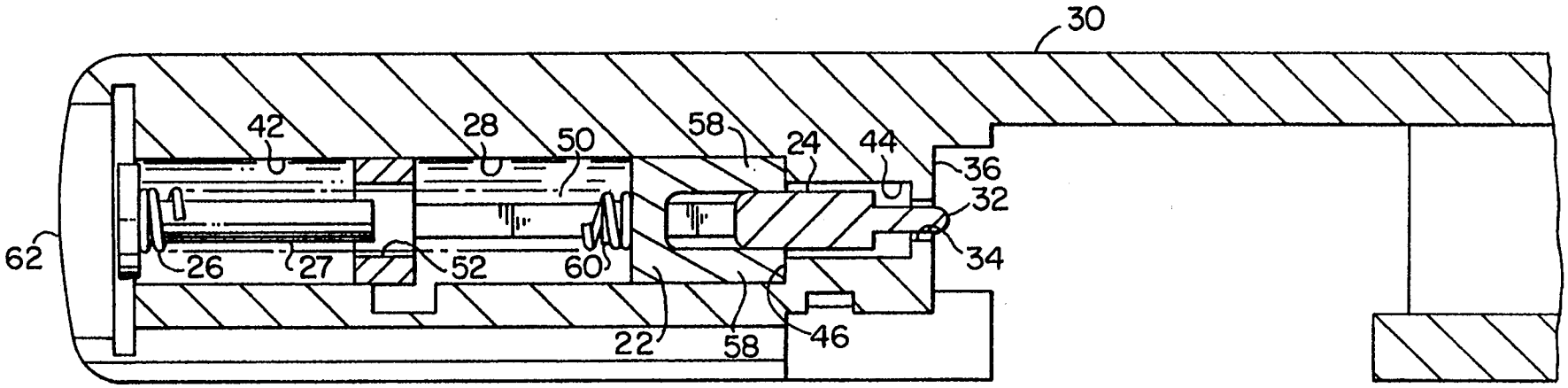
FIG. 5 is a fragmentary sectional view, taken along the line 5—5 of FIG. 4.

The striker 24 is generally cylindrical, supported for coaxial sliding movement within the bore 28 between a cocked position (FIGS. 2 and 3) and a firing position (FIGS. 4 and 5). The striker has a forwardly facing annular shoulder 48 for cooperative engagement with the annular abutment surface 46 to limit the forward travel of the striker within the bore portion 42. A forward end portion of the striker 24 has a reduced diameter and is adapted to be freely received within the intermediate bore portion 44. At its forward or free end the striker 24 has a tip 32 sized for free passage through the forward bore portion 34 and to a striking position beyond the breech face 36. An axially extending transverse opening 50 in the striker 24 rearward of the shoulder 48 intersects a bore 52 which extends coaxially through the rear part of the striker as shown in FIGS. 3 and 5. An integral tongue 54 depends from the rear end of the striker 24 and projects downwardly through and beyond an associated slot 56 formed in the lower rear portion of the slide body 30 and best shown in FIGS. 2 and 4. The spacer which drives the striker 24 through a portion of its travel through the bore 28 and toward its striking position (FIGS. 4 and 5) comprises a generally U-shaped member 22, best shown in FIG. 7, which is disposed within the forward end of the opening 50 and straddles a forward portion of the striker 24. The U-shaped spacer has a pair of forwardly projecting legs 58, 58 which extend forwardly beyond the shoulder 48 when the U-shaped spacer is disposed in driving engagement with the striker 24. The striker spring 26 is received on the striker spring guide rod 27, extends through the bore 52 and engages a spring retainer 60 on the rear of the U-shaped spacer, substantially as shown.

The striker assembly is retained in assembly with the slide body 30 by a back plate 62 received in slots at the rear of the slide body and which provides a closure for the rear end of the bore 28. The striker spring 26 acts between the U-shaped spacer 22 and the back plate 62 to propel the striker 24 in a forward direction and toward its striking position as will be hereinafter further discussed.

When the gun is fired by operating the trigger 18, the spacer 22 and the striker 24 are propelled from cocked position toward firing position. The legs 58, 58 on the spacer engage the annular abutment surface 46 within the bore 28 to arrest further forward movement of the spacer 22. Thereafter, the striker 24 continues to move relative to the slide body 30 and the spacer 22 in response to inertia to complete the final portion of its travel to firing position. In the latter position the tip 32 projects through and beyond the breech face 36, as previously discussed to strike and detonate the primer of an associated cartridge (not shown).

The foregoing description represents an invention relating to the orientation axially of a striker spacer, which initially abuts the striker body in the cocked position, but separates therefrom by the action of a shoulder in the bore through which both spacer and striker body travel under the thrust of a striker spring. This description is not intended to provide the limitations and extent of the invention, which is provided only by the following claims:

What is claimed is:

1. An inertia striker mechanism for a firearm and comprising a slide body having a forwardly facing breech face and a bore extending through a portion of said slide body and opening through said breech face, a striker assembly supported for reciprocal sliding movement within said bore and including a striker having a tip at its forward end and supported for reciprocal axial movement within the bore between cocked and firing position, said tip projecting thorough and forwardly beyond said breech face when said striker is in its firing position, a generally U-shaped spacer straddling an associated portion of said striker, biasing means for urging said spacer and said striker in the direction of said firing position, and arresting means on said slide body for halting movement of said U-shaped spacer toward said firing position before said striker reaches said firing position, said striker being freely moveable relative to said slide body and said U-shaped spacer in response to inertia during the final portion of its travel from said cocked position to said firing position.

2. An inertia striker mechanisms as set forth in claim 1 wherein said striker has an axially extending opening therethrough and said U-shaped spacer extends through said opening.

3. An inertia striker mechanism as set forth in claim 1 wherein said arresting means comprises an abutment surface on said slide body.

4. An inertia striker mechanism as set forth in claim 3 wherein said arresting means comprises an annular abutment surface within said bore.

5. An inertia striker mechanism as set forth in claim 1 wherein said biasing means comprises a spring acting between said slide body and said U-shaped spacer.

6. An inertia striker mechanism as set forth in claim 5 wherein said slide body includes a back plate forming a closure for the rear end of said bore and said spring acts between said back plate and said U-shaped spacer.

7. An inertia striker mechanism as set forth in claim 1 wherein said biasing means comprises a spring and said mechanism includes a spring guide rod supported in fixed position relative to said slide body and extending into said spring.

8. An inertia striker mechanism as set forth in claim 7 wherein said slide body includes a back plate forming a closure for the rear end of said bore and said spring guide rod extends from said back plate into said spring.

9. An inertia striker as set forth in claim 7 wherein said U-shaped spacer has a pair of forwardly extending legs straddling said striker for engaging said arresting means.

10. An inertia striker mechanism as set forth in claim 9 wherein said arresting means comprises an abutment surface on said slide body.

11. An inertia striker as set forth in claim 9 wherein said bore is further characterized as a stepped bore and said arresting means comprises a radially disposed annular abutment surface of said bore.

* * * * *